United States Patent [19]

Antes

[11] Patent Number: 4,770,645

[45] Date of Patent: Sep. 13, 1988

[54] CABLE CONDUCTOR TO PRINTED WIRING BOARD CONDUCTOR CLAMP

[76] Inventor: Jack E. Antes, 14652 Cheshire Pl., Tustin, Calif. 92680

[21] Appl. No.: 520,579

[22] Filed: Aug. 5, 1983

[51] Int. Cl.[4] ..... H01R 9/07

[52] U.S. Cl. ..... 439/329; 439/493

[58] Field of Search ..... 339/17 F, 176 MF, 103 M; 439/77, 329, 492–499

[56] References Cited

U.S. PATENT DOCUMENTS

| | | | |
|---|---|---|---|
| 3,816,818 | 6/1974 | Meier | 339/17 F |
| 4,023,877 | 5/1977 | Hennessey et al. | 339/176 MF |
| 4,376,562 | 3/1983 | Kaley | 339/17 CF |
| 4,420,206 | 12/1983 | Martyniak | 339/17 F |

FOREIGN PATENT DOCUMENTS

| | | | |
|---|---|---|---|
| 73528 | 3/1983 | European Pat. Off. | 339/17 F |

*Primary Examiner*—J. Patrick McQuade

*Attorney, Agent, or Firm*—Knobbe, Martens, Olson & Bear

[57] ABSTRACT

A method and an apparatus for connecting a plurality of electrical cable conductors to a corresponding plurality of conductors on a printed wiring board is provided. A section of the insulation at the termination end is displaced away from the adjacent section of insulation, thereby exposing bare conductors between the two insulated sections. The prepared termination end of the cable is then attached to a wire retaining device which guides the exposed conductors horizontally and vertically into physical contact with the printed wiring board conductors while isolating the conductors from each other. The retaining device is firmly clamped to the printed wiring board, thereby squeezing the ribbon cable conductors between the printed wiring board and the retaining device to provide an excellent electrical contact between the respective cable and printed circuit board conductors.

13 Claims, 2 Drawing Sheets

CABLE CONDUCTOR TO PRINTED WIRING BOARD CONDUCTOR CLAMP

BACKGROUND OF THE INVENTION

This invention relates to an improved apparatus and a method for connecting the conductors from a multi-wire cable to surface-mounted conductive pads on a printed wiring board. One of the key features of the present invention is that the cable conductors are directly connected to the printed wiring board conductors without the use of intermediate contacts or pins.

Flat cables which contain many separate conductors are commonly used in addressing the multiple connection needs. The prior art adopts two different types of flat cable. Flat conductors, rectangular in cross section, characterize one such type of cable. A common sleeve of insulation collectively insulates all the flat conductors contained in the cable by rigidly attaching each of the respective conductors to the inside of the sleeve in a spaced apart configuration so that they do not short against one another.

Round conductors characterize the other type of flat cable. Typically, individual tubes of insulation enclose each of the conductors. A plurality of such insulated round conductors are flexibly attached together to form a flat cable.

The currently available round conductor connectors are relatively expensive, multi-part devices. Typically, the conductor from a flat round conductor cable is connected to an intermediate contact which in turn is mated through a connector with another intermediate contact, which in turn is soldered to a printed wiring board trace.

The state of the art round conductor cable to intermediate contact connection typically involves an insulation displacement connector (IDC). The round conductor cable is pressed into an IDC connector header causing one end of the intermediate contact to puncture or displace the insulation and contact the cable conductors. The cable conductor thus makes an electrical connection to the internal intermediate contact.

The IDC connectors have problems in the areas of cost and reliability. These connectors tend to be expensive because they involve both a header and a multiplicity of intermediate contacts. The reliability of IDC connectors is low because the insulation puncturing contact to cable conductor connection is subject to two failure modes. In one failure mode, the puncturing contact cuts the cable conductor and an open circuit results. In the other failure mode, two adjacent intermediate contacts can short out.

Although relatively simple connectors presently exist to interface rectangular conductor flat cable to printed wiring board traces, such connectors are not satisfactory for round conductor cable. The reason for this is that the problems associated with making a suitable electrical termination with the rectangular conductor cable and round conductor cable are quite different. Thus, with rectangular conductor cable, insulation can be readily removed from only one side of the cable since the conductors will remain spaced apart because they are attached to the remaining insulation on the other side of the cable. However, for round conductor cables, the conductors, when exposed, are not rigidly attached to any insulation base. Thus, when insulation is removed from the round conductors, the uninsulated portions are free to move around and short with another conductor.

SUMMARY OF THE INVENTION

The present invention relates to making electrical connections between cable conductors and printed wiring board traces and providing electrical jumpering between printed circuit boards or associated input-output equipment. The cable conductors directly contact the printed wiring board traces without the use of intermediate contacts. A multi-wire retainer aligns the cable conductors both horizontally and vertically so that the conductors are positioned to contact corresponding traces. The multi-wire retainer attaches to the printed wiring board, thereby clamping the cable conductors to the printed wiring board traces.

One key feature of the preferred embodiment of the present invention is that the conductors of the round conductor flat cable directly contact the printed wiring board traces. Since the round conductors directly contact printed wiring board traces, no intermediate contacts are required in the cable-to-printed wiring board connection. As a result, clamps constructed in accordance with the invention are less expensive to produce because they do not require these intermediate contacts. The present invention has also the further advantage of eliminating the failure modes inherent in using intermediate contacts.

Another key feature of the present invention concerns the preparation of round conductor flat cable for electrical connection with printed wiring board traces. In the preferred embodiment, the insulation enclosing each conductor of the cable is slid a short distance away from adjacent insulation on each of the conductors. This exposes a strip of bare conductors between two insulated supports and tends to hold the cable conductors in position while preventing the cable conductors from shorting.

Still another key feature of the present invention is the use of a ridge bar to accomplish a plurality of functions. In a preferred embodiment, the ridge bar is a nonconductive bar encircled by the connection end of the electrical cable. The ridge bar, by so bending the cable, causes the exposed cable conductors to protrude beyond the plane of the cable insulation to physically contact the printed wiring board traces. It positions the cable conductors in a plane perpendicular to the printed wiring board so that the cable conductors directly contact these traces. It further positions the cable conductors in a plane parallel to the printed wiring board so that each conductor may come into contact with its respective printed wiring board trace. It further transfers forces to each cable conductor in a direction perpendicular to the printed wiring board such that the cable conductors are clamped to the printed wiring board. Additionally, the ridge bar is a nonconductive material which is formed to prevent adjacent cable conductors from shorting.

Yet another key feature of the present invention concerns the use of standoff ribs integral with the above mentioned ridge bar. The standoff ribs allow perpendicular forces exerted by the ridge bar on the cable conductors and printed wiring board to be concentrated at one point on each conductor thereby amplifying the clamping pressure. Further, the standoff ribs are constructed from a semi-elastic material and constructed in a particular shape and size so that the standoff ribs deform before the cable conductors are cut, but not until sufficient clamping pressure can be maintained on the cable conductors.

Other important features of this invention will become apparent from a study of the following specification, claims, and the attached drawings.

OVERALL COOPERATION OF THE MAJOR ELEMENTS OF THE PREFERRED EMBODIMENT

Figure 1:
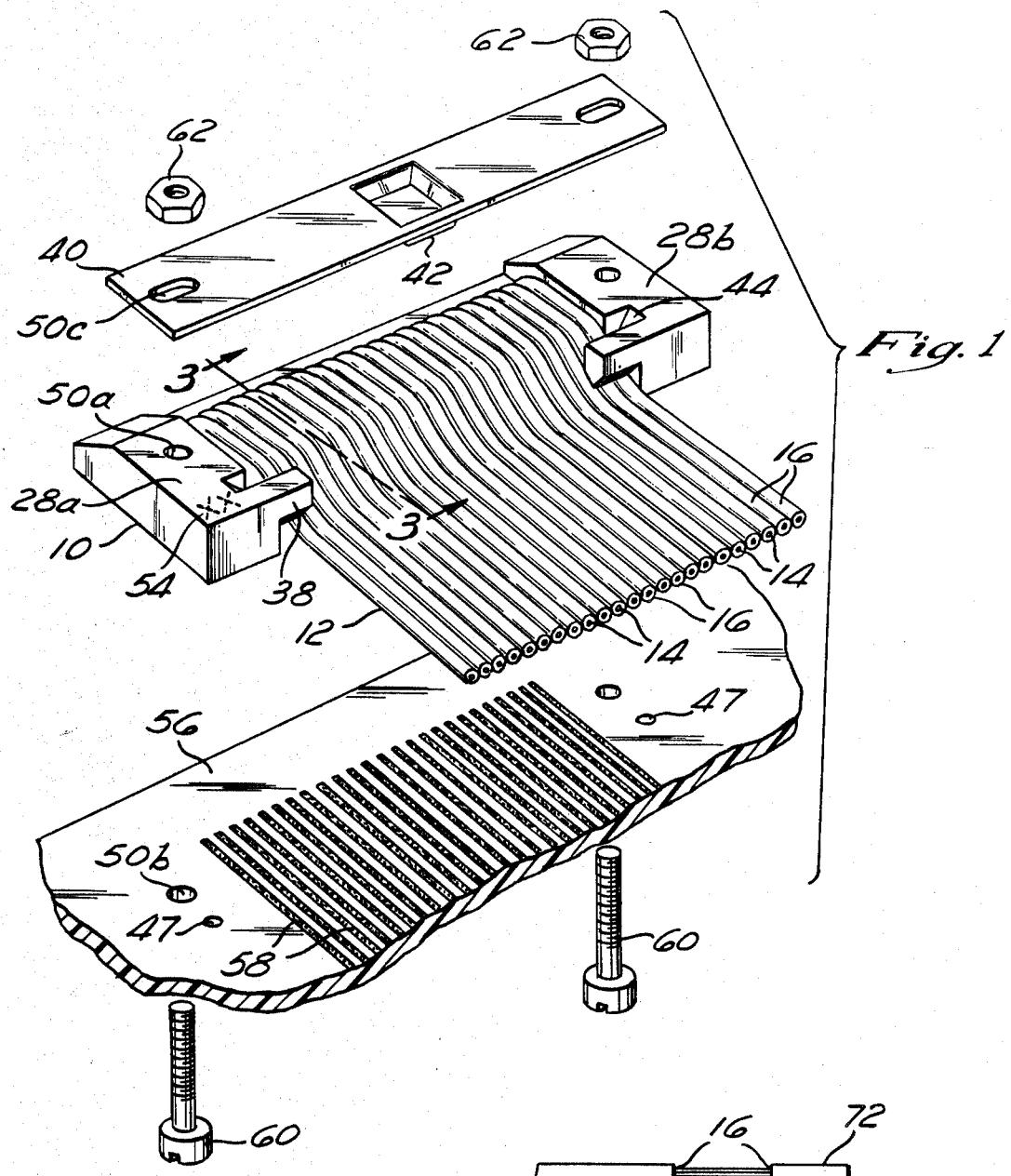
FIG. 1 is a perspective, exploded view of the present invention, showing the cooperation of the invention's major features.

FIG. 1 illustrates the overall cooperation of the major parts of the preferred embodiment of the present invention. Exposed portions of each conductor 14 of round conductor flat ribbon cable 12 are retained suitably spaced apart by a multi-wire retainer 10. The retainer 10 and ribbon cable 12 combination fastens to the printed wiring board 56 in juxtaposition with etched conductive traces or pads 58. A reinforcing bar 40 attaches to retainer 10 such that retainer 10 is sandwiched between reinforcing bar 40 and printed wiring board 56. Respectively aligned holes **50*a*, 50*b* and 50*c* on retainer 10, printed wiring board 56, and reinforcing bar 40 are used in attaching these three parts together by means of a bolt 60 and nut 62. When the retainer 10 and cable 12 combination is fastened to printed wiring board 56, exposed portions of the conductors 14 (shown in FIG. 3) are squeezed between multi-wire retainer 10 and printed wiring board 56 so that the exposed conductor portions are respectively retained in direct contact with corresponding respective traces 58**.

Figure 3:
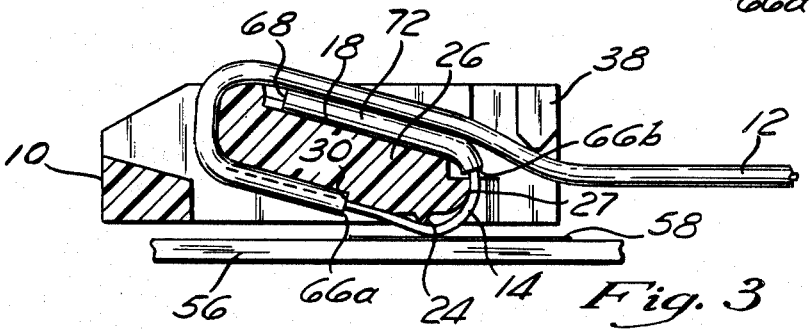
FIG. 3 is a sectional view of the present invention, taken substantially along line 3—3 in FIG. 1 as would be seen if assembled.

FIG. 3 shows a cut away view of ribbon cable 12 terminated in multi-wire retainer 10 and in position relative to printed wiring board 56. In the illustration of FIG. 3, retainer 10 and printed wiring board 56 are not yet tightly fastened together. However, when tightly fastened together, the cable 12 and printed wiring board 56 conductors are held in mutual contact through forces acting perpendicular to the length of conductors 14 and printed wiring board 56. These perpendicular or normal forces, which are provided through screws 60 and nuts 62 (see FIG. 1), are transferred to each conductor through multi-wire retainer 10.

Multi-wire retainer 10 thus both terminates the round ribbon conductors 14 but also maintains them in alignment with conductive traces 58 on printed wiring board 56. Retainer 10 also isolates exposed conductors 14 from each other, and serves as a pattern for forming or bending ribbon cable 12 into a configuration providing a predetermined point of contact between conductors 14 and conductive traces 58. In the preferred embodiment, retainer 10 is constructed from one piece of molded plastic. Thus, all portions of retainer 10 are nonconductive.

Multi-retainer 10 can also advantageously display information, such as denoted by reference number 54 in FIG. 1. For example, retainer 10 can convey information concerning the size and types of cables which may be accommodated.

Although FIG. 1 depicts screws 60 and nuts 62 as securing and exerting forces on multi-wire retainer 10, those skilled in the art will recognize that other forms of attaching multi-wire retainer 10 to printed wiring board 56, such as rivets or self tapping screws, can be used to tightly fasten multi-wire retainer 10 to printed wiring board 56 to create a good electrical connection between respectively all of the cable and printed circuit board conductors.

The Printed Circuit Board 56

Printed wiring board 56, shown in FIGS. 1 and 3, is typical of many common and specialty type printed wiring boards. These printed wiring boards are typically geometrically flat substrates with conductive materials attached to at least one side. Conductive traces 58 are typical of these conductive materials. Other suitable printed wiring boards have conductors on both sides or conductors embedded internally in the printed wiring board. Additionally, printed wiring board 56 contains some provision, such as hole **50*b*, allowing multi-wire retainer 10 to be attached to printed wiring board 56**.

Conductive materials such as conductive traces 58 are typically formed on the surface of printed wiring boards, such as printed wiring board 56, by a process known as etching. The etching process removes unwanted conductive material from a printed wiring board whose entire surface is coated with this conductive material. The remaining conductive material is thus configured in some desired design and may be called etched traces. Other method of forming conductors or traces are known to the art. Such methods include the use of conductive ink or positively-fixing any conductive material in a desired design on the surface of a nonconductive object. Those skilled in the art will recognize that the teaching of this preferred embodiment can be applied equally well to many variations of the typical etched traces on a typical printed wiring board.

In the present invention conductive traces 58 conform to certain design requirements. These conductive traces 58 are spaced apart from each other to correspond to the spacing between channels or pockets 22, shown in FIG. 5, of multi-wire retainer 10. For simplicity, representative sample of channels 22 are also illustrated in the bottom view of retainer 10 shown in FIG. 6. This spaced apart requirement applies only in the area of printed wiring board 56 where retainer 10 is fastened. Additionally, those skilled in the art will recognize that the requirement may be modified if one does not want all conductors 14 to make a one-to-one electrical connection with an equal number of the conductive traces 58.

The materials from which conductive traces 58 are made will be dictated by the application. A typical conductive material, such as copper or copper coated with solder will be sufficient for most applications. However, those skilled in the art will recognize that conductor 58 in some applications may have a special plating, such as gold. Other applications may allow etched traces 58 to be constructed from a fragile substance such as conductive ink.

The Round Conductor Ribbon Cable 12

Ribbon cable 12 typically includes several wires of round, single stranded conductors. Each of these wires comprises a conductor 14 enclosed in its own tube of insulation 16. Insulation 16 is necessary to prevent an unwanted electrical connection between individual conductors 14 or between an individual conductor 14 and an external conductor. The insulation tube of each wire attaches along the length of the wire to the insulation tube of an adjacent wire to form a flat cable. The length of the cable will be determined by the application. The present invention contemplates a large variation in the number of wires in a cable, in the size of conductors used, and in the type and thickness of insulation used. Those skilled in the art will further recognize that the present invention can be adopted to accommodate multi-strand conductor wires, conductors with a rectangular cross sectional area, and conductors that have been plated with other conductive substances.

In the preferred embodiment cable wire insulation 16 is characterized by a particular spacing between adjacent conductors 14. This spacing is consistent between each of conductors 14. Spacing between two adjacent conductors 14 is defined by the thickness of the insulation surrounding one conductor, plus the thickness of the insulation surrounding the other conductor, plus some small distance which may be needed to flexibly attach the insulation of the two conductors.

However, those skilled in the art will recognize that other types of cables may also be applied in the present invention. For example, stranded conductors may be used in place of solid wire conductors 14. Additionally, since multi-wire retainer 10 positions the conductors into alignment with conductive traces 58 both flat conductor cable and noninsulated wires could be adapted to this invention. Moreover, alternative embodiments of the present invention can accommodate inconsistent conductor spacing and sizes.

Preparation of the Ribbon Cable

Figure 2:
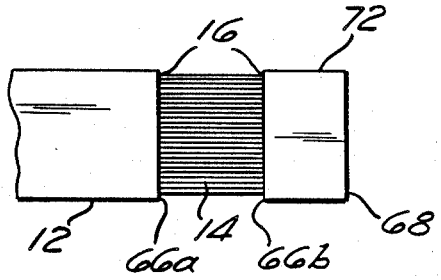
FIG. 2 is a top view of a ribbon cable used with this invention, prepared for termination in the multi-wire positioner.

In order to make the desired electrical connection to which this invention relates, insulation 16 is first removed from a portion of conductors 14. As shown in FIG. 2, insulation 16 has been completely removed from conductors 14 along a portion of cable 12 leaving a stripe of bare conductors between cut edges **66*a* and 66*b* formed by separating the insulation along cut line 66. The separation is typically accomplished by scoring the insulation along cut line 66. Cut line 66 is made across the width of ribbon cable 12 and substantially perpendicular to its length. This cut line 66 is advantageously made on both sides of ribbon cable 12 after which the user removes insulation from a section of the conductors 14 by solidly holding the cable, both insulation and conductors, along one side of cut line 66. The insulation is then slid from the other side of cut line 66 thereby exposing bare portions of the conductors 14**.

By way of specific example, for a flat cable comprising No. 28 AWG solid conductors, the amount of insulation displaced is approximately 0.30 inch of conductor 14. This distance is not critical, but if too short a length of conductor 14 is exposed one may find it difficult to properly adapt multi-wire retainer 10 to ribbon cable 12. On the other hand, if too much bare conductor 14 is exposed one may find it difficult to retain an end section of insulation 72, shown between **66*b* and 68 on the end of ribbon cable 12, or to prevent unwanted electrical connections between conductors 14 within multi-wire retainer 10**.

After insulation 16 has been displaced exposing conductors 14, the end of ribbon cable 12 may be trimmed along trim line 68. In the exemplary embodiment, an approximately ¼ inch end section of insulation 72 remains to enclose conductors 14 between edge **66*b* and trim line 68. The use of this remaining end section of insulation 72 is a significant feature of this invention as it maintains all of the conductors 14 within ribbon cable 12 as one unit because the insulation of each conductor is still attached to the insulation of adjacent conductors. Additionally, it tends to hold conductors 14 apart from each other at both edge 66*a* and 66*b***, which in turn tends to prevent unwanted electrical connections between adjacent conductors.

Mounting the Cable 12 to the Retainer 10

Ribbon cable 12 is mounted to multi-wire retainer 10 from the front or left hand side of retainer 10, as seen in FIG. 3. Cable 12 is positioned so that the end of the insulation at edge **66*a* abuts against insulation stop 30. Insulation stop 30 is additionally illustrated in FIGS. 5 and 6. The remainder portion of cable 12 is then bent around from the printed wiring board side of pressure ridge or ridge bar 26 to the opposite side thereof so that the end section of insulation 72 on cable 12 is located on top of ridge bar 26 within recess 18 which accommodates various trimmed lengths of the end cable insulation section 72. The other free or non-termination end of ribbon cable 12 is then bent up over the top of ridge bar 26 and routed out the back of multi-wire retainer 10 underneath strain relief ears 38 (see FIG. 1**).

Frictional forces prevent cable 12 from slipping out of multi-wire retainer 10. First, ribbon cable 12 is bent around several corners of ridge bar 26 so that frictional forces resist the cable's slipping out of multi-wire retainer 10. Additionally, cable 12 exerts frictional forces by overlying itself in the area on top of ridge bar 26 within recess 18. Finally, strain relief ears 38 force cable 12 downward and provide additional frictional forces. Those skilled in the art will recognize that additional strain relief provisions could be added. For example, double sided tape could be inserted between the insulation end section 72 and the top of ridge bar 26. Or, double sided tape could be added between insulation end section 72 and ribbon cable 12 where it is juxtaposed with the end section on top of ridge bar 26.

The Ridge Bar 26

FIGS. 3–6 show the particular shape and orientation of the ridge bar 26 in the preferred embodiment. Recess 18 and insulation stop 30 aid in positioning the cable around ridge bar 26 and in preventing unnecessary bends in conductors 14. The ridge bar edge 27 around which exposed conductors 14 are formed is another important feature of this invention. In order that the cable conductors directly contact printed wiring board traces, the exposed portions of the cable are bent so that conductor 14 protrudes beyond the plane defined by the external surface of insulation 16. This edge 27 of ridge bar 26 causes the exposed conductors to so protrude since, as can be seen in FIG. 3, exposed conductor 14 extends beyond an imaginary line drawn from the outside of insulation 16 at cut line **66*a* to the outside of the insulation at cut line 66*b*. Ridge bar 26 lies generally in an oblique plane relative to the plane of the printed circuit board with the back side of ridge bar 26 resting near the bottom of the multi-wire retainer 10 while the front side of ridge bar 26 rests near the top. This positions, the exposed conductors 14 downwardly so that they contact printed wiring board trace 58 as retainer 10 is clamped to printed wiring board 56**.

The present invention insures that a good electrical connection occurs when conductors 14 contact traces 58. As noted above, the process of forming cable 12 around the edge 27 of ridge bar 26 causes the exposed portions of conductors 14 to protrude beyond the printed wiring board side of retainer 10. As retainer 10 is clamped tightly against printed wiring board 56, protruded, exposed conductors 14 have a tendency to deflect thereby skimming off oxides which may be formed on either traces 58 or a conductor 14. The result is a good conductor-to-conductor contact as conductors 14 reach their final seated position.

Figure 5:
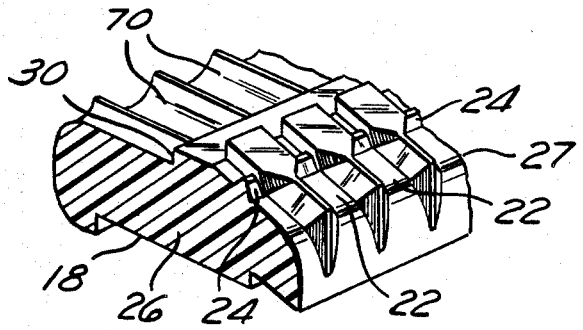
FIG. 5 is a partial section showing generally the bottom view of a ridge bar of the multi-wire positioner.
Figure 6:
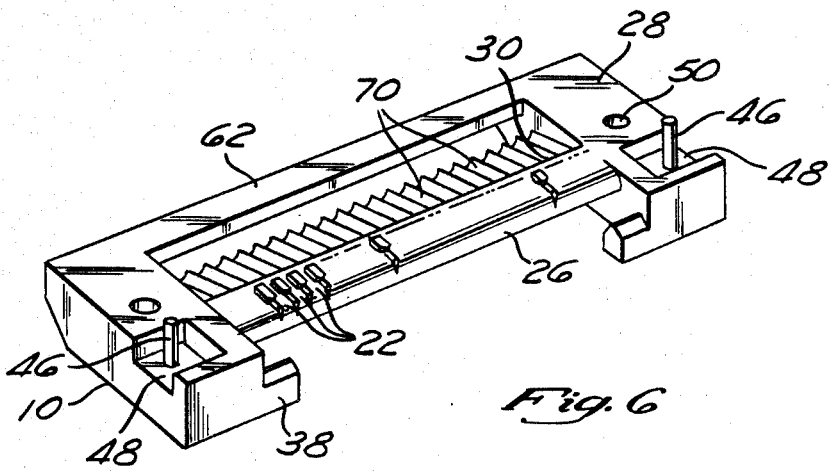
FIG. 6 is a bottom perspective view of the multi-wire positioner.

FIGS. 5 and 6 show a view of the bottom side of ridge bar 26. Channels 22, standoff ribs 24, and insulation guides 70 are depicted. Channels 22 represent another of the key aspects of the present invention. First the channels are spaced apart a distance which corresponds to the distance between conductors 14 in ribbon cable 12. The channels allow each of conductors 14 to be both electrically and mechanically isolated from other conductors 14. The channels tend to prevent conductor 14 from slipping from side to side within multi-wire retainer 10. Additionally, FIG. 5 shows that the walls between channels 22 are beveled. The beveled walls aid in guiding conductors 14 into corresponding channels 22.

Standoff ribs 24 are positioned in the bottom of channels 22 along ridge bar 26 approximately in the plane of the retaining member that abuts the surface of the printed circuit board so that the ribs 24 contact conductors 14 at the contact point where conductor 14 engages printed wiring trace 58. Standoff rib 24 provides a point contact so that any forces exerted downwardly through ridge bar 26 are concentrated at the point of contact. The point contact feature has the effect of increasing the clamping force between the ridge bar and the printed wiring board. In the preferred embodiment standoff rib 24 is constructed from a semi-elastic material so that it will deform as it exerts forces on conductors 14. The deformation of standoff ribs 24 tends to allow conductors 14 to travel upwardly into retainer 10 as retainer 10 is clamped to printed wiring board 56. This deformation also prevents cutting the exposed portions of conductor 14 at the point of contact while still allowing an excellent mechanical and electrical connection.

The height of standoff ribs 26 within channels 22 is determined by the diameter of the conductors being used and the depth of channels 22. In the preferred embodiment standoff ribs 24 are dimensioned so that they are shorter than the diameter of conductor 14. This is large enough to ensure that conductor 14 extends outside of channels 22, and therefore outside of multi-wire retainer 10, but is small enough to transfer force from ridge bar 26 to conductors 14 without deforming too easily.

Insulation channels 70 are semi-circular troughs formed in the printed wiring board side of ridge bar 26 where ridge bar 26 angles away from printed wiring board 56. channels 70 guide cable 12 into its seating position, and aid in aligning cable 12 with retainer 10.

In certain applications, the normal forces exerted by the ridge bar upon the exposed conductors will be ample without use of the reinforcing bar 40 shown in FIG. 1. Also, ridge bar 26 may be formed to have a slight convex bow when it is in a relaxed condition. The outside of the bow on ridge bar 28 will then be placed against conductors 14 which are in turn placed against conductive pads 58 formed on printed wiring board 56. In other words, the unclamped retainer 10 can be placed so that the center of ridge bar 26 is in contact with printed wiring board 56, but a gap appears between the two ends of ridge bar 26 and printed wiring board 56. When end bars **28*a* and 28*b* are clamped to printed wiring board 56 through screws 60 and nuts 62, ridge bar 26 will be flattened, and sufficient normal forces will be maintained throughout the length of ridge bar 26**.

The Reinforcing Bar 40

Reinforcing bar 40 is constructed from a sufficiently rigid conductive or non-conductive material to transfer the force exerted by screws 60 and nuts 62 to the interior of the bar at pressure point 42 (see FIG. 1) without excessive deformation. Pressure point 42 contacts the top, central area of ridge bar 26. Thus, through the use of reinforcing bar 40 additional normal forces can be exerted through ridge bar 26 to assure that the center of conductors 14 are sufficiently clamped to printed wiring board 56.

Further Details of the Preferred Embodiment

Figure 4:
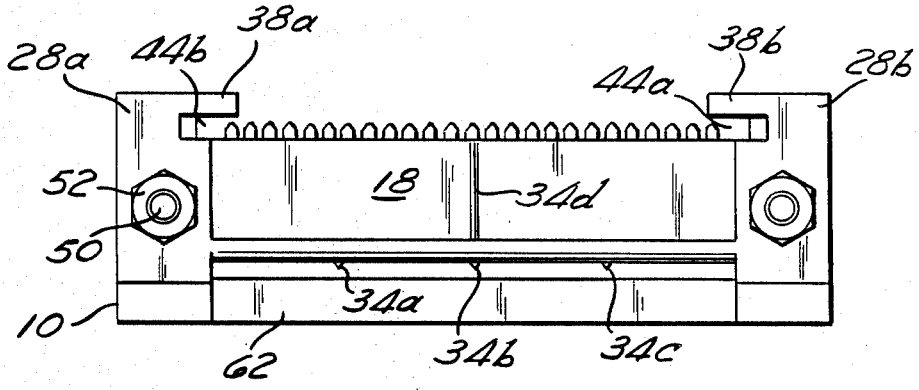
FIG. 4 is a top view of the multi-wire positioner.

In FIG. 4 a top view of multi-wire retainer 10, without attached ribbon cable 12, is shown. Hexagonal nut-well 52, shown in FIG. 4, is a recessed area on end bar 28 which surrounds hole 50. A standard hexagonal nut, which may be used in fastening retainer 10 to printed wiring board 56, fits tightly inside nut well 52. The walls of nut well 52 will prevent such a fastening nut from turning as a screw is being tightened or loosened.

Strain relief ears **38*a* and 38*b* are also shown in FIG. 4. Ribbon cable 12 tucks under these ears as it exits from retainer 10. Ears 38 are each cantilever bars, attached on one end to a corresponding end bar 28. Cable 12 is forced toward printed wiring board 56 as it exits from retainer 10 under ears 38 which result in a comparatively large area of contact between cable 12 and strain relief ears 38, the insulation end section 72 and ridge bar 26**. This contact area provides sufficient frictional force in most applications for the strain relief function.

FIG. 4 shows alignment ribs **38*a*, *b*, *c* and *d*. Each of these ribs is smaller in diameter than the wires of ribbon cable 12. As ribbon cable 12 is formed around ridge bar 26 these alignment ribs tend to align the cable on center and prevent the cable from slipping transversely toward end bars 28*a* and 28*b*. Alignment ribs 34 are small enough in diameter that they do not cause cable 12 to protrude away from ridge bar 26**.

The front brace 62 shown in FIGS. 4 and 6 is connected between end bars **28*a* and 28*b* at the front of multi-wire retainer 10. Brace bar 62 provides additional overall strength to multi-wire retainer 10**.

View windows **44*a* and 44*b* are shown in FIG. 4 located adjacent to strain relief ears 38*a* and 38*b*. View windows 44 are essentially cut away areas in end blocks 28 in the preferred embodiment so that the user can observe through these view windows the position of the outside of conductors 14 of cable 12 and their alignment relative to printed wire board conductive pads 58**.

FIG. 6 illustrates alignment post 46 and alignment post well 48. Alignment post 46 mates with a corresponding alignment hole 47 on printed wiring board 56

(shown in FIG. 1) to positively position retainer 10 relative to traces 58. Alignment post 46 is an optional feature which may be removed using common wire cutters. Alignment post well 48 is provided to facilitate removing post 46 without leaving a post stub protruding beyond the bottom of retainer 10.

What is claimed is:

1. An apparatus for directly connecting exposed portions of round conductors of an otherwise insulated multi-wire flat cable to respective trace conductors formed on a printed circuit board without the use of intermediate contacts or pins, said apparatus comprising:

(a) a retaining member for aligning and fastening said exposed conductors in direct physical contact with said printed circuit board trace conductors, said retaining member being formed of a one-piece construction having;

(1) a ridge bar, around which said exposed round conductors may be retained, for applying sufficient force normal to each of said exposed round conductors to insure a good electrical contact between said round conductors and said trace conductors respectively;

(2) a series of channels formed integrally on said ridge bar and spaced in accordance with said exposed round conductors and said trace conductors; and (3) a deformable standoff rib formed in each of said channels for directly contacting said exposed round conductors to concentrate said normal force at one point on each of said exposed round conductors; and (b) means for aligning and securing said retaining member to said printed circuit board.

2. An apparatus as in claim 1 wherein said channels are shallower than the diameter of said exposed portions of the round conductors so that said conductors protrude beyond the surface of the retaining member adjacent said printed circuit board to physically contact said printed circuit board trace conductors.

3. An apparatus as in claim 2 wherein said ridge bar generally lies in an oblique plane relative to the plane of said printed circuit board with said deformable standoff ribs being located substantially in the plane of the surface of said retaining member which abuts said printed circuit board.

4. An apparatus as in claim 1, 2, or 3 wherein said ridge bar includes a recessed section on the surface opposite the surface of said printed circuit board which accommodates various lengths of the end portion of said ribbon cable.

5. An apparatus as in claim 1 wherein said ridge bar includes on the surface adjacent said printed circuit board a series of insulation guides corresponding in spacing with said channels, said guides positioned to support an insulated portion of said flat cable immediately adjacent to the exposed portion of said cable.

6. An apparatus for making electrical connections to a plurality of surface mounted conductive pads, comprising:

(a) an electrical cable having a plurality of conductors;

(b) means spanning said plurality of conductors for directly contacting said conductors to press said conductors against said conductive pads, said means being formed of a one-piece nonconductive construction;

(c) means integral with said contacting means for aligning each of said conductors with said conductive pads; and (d) means for fastening said contacting means to said surface thereby clamping said conductors between said contacting means and said surface, wherein said contacting means comprises a ridge bar having an elongated cross-sectional shape, said ridge bar oriented so that one end of said elongation is nearer said surface mounted conductive pads than the other end of said elongation.

7. An apparatus as in claim 6 wherein said ridge bar comprises:

a beam having a convex bow side when said beam is in a relaxed state, said beam oriented with the outside of said bow juxtaposed with said conductors so that as said beam is clamped flat against said surface by said fastening means substantially equivalent forces perpendicular to said beam are maintained against one side of each of said conductors.

8. An apparatus as in claim 6 additionally comprising:

a plurality of standoff ribs integral with said ridge bar, said standoff ribs located to correspond to said plurality of conductors at substantially the point of contact between said conductors and said conductive pads, said standoff ribs concentrating the forces transmitted to said conductors from said ridge bar.

9. An apparatus as in claim 8 wherein said stand off ribs are formed of a semi elastic material so that said standoff ribs will deform as clamping forces are transmitted from said ridge bar through said standoff ribs to one side of said conductors without harming said conductors.

10. An apparatus for electrically connecting a plurality of conductors to a plurality of printed wiring board traces, comprising:

(a) two end bars;

(b) means, integral with each of said end bars, for securing said end bars to said printed wiring board and for transferring clamping forces to said end bars;

(c) A pressure ridge connected between said two end bars and integral therewith for transmitting clamping forces from said two end bars to said conductors;

(d) pocket means, integral with said pressure ridge, for mechanically and electrically isolating each of said conductors from other said conductors and for positioning each of said conductors relative to corresponding traces;

(e) pressure means integral with said pocket means and in direct contact with each of said conductors at the contact point between each of said conductors and said printed wiring board traces, said pressure means being operative to concentrate said transferred clamping forces to a point on one side of each of said conductors; and (f) a cantilever strain relief ear integral with either of said two end bars, said ear positioned near said pressure ridge and pointing toward the other of said two end bars, so that said conductors fit between said ear and said pressure ridge.

11. An apparatus as in claim 10, additionally comprising:

means, integral with said end bars, for allowing the viewing of alignment between at least one of said plurality of conductors and said printed wiring board traces.

12. An apparatus as in claim 11 additionally comprising:

alignment ribs integral with and transversing said pressure ridge for positioning said plurality of conductors between said two end bars.

13. An apparatus as in claim 12, additionally comprising:

(a) alignment posts integral with said two end bars and extending perpendicular from said two end bars towards said printed wiring board to aid in positioning said conductors relative to said printed wiring board traces; and (b) alignment wells integral with said two end bars from which said alignment posts protrude, said wells having an open side portion and a recessed bottom portion adapted to permit cutting of said alignment posts at a point recessed from the surface of said end bar.

* * * * *